US007377837B2

(12) United States Patent
Piliguian

(10) Patent No.: US 7,377,837 B2
(45) **Date of Patent: *May 27, 2008**

(54) GRINDING OR POLISHING ARRANGEMENT

(76) Inventor: Raffi Piliguian, 345 Morris Pl., Montebello, CA (US) 90640

( * ) Notice: Subject to any disclaimer, the term of this patent is extended or adjusted under 35 U.S.C. 154(b) by 0 days.

This patent is subject to a terminal disclaimer.

(21) Appl. No.: 11/186,122

(22) Filed: Oct. 3, 2005

(65) Prior Publication Data

US 2006/0040597 A1 Feb. 23, 2006

Related U.S. Application Data

(62) Division of application No. 10/062,930, filed on Jan. 30, 2002, now abandoned.

(51) Int. Cl.
*B24B 49/00* (2006.01)

(52) U.S. Cl. ..... 451/6; 451/259; 451/359; 451/548

(58) Field of Classification Search ..... 451/6, 451/9, 158, 259, 294, 359, 527, 528, 548
See application file for complete search history.

(56) References Cited

U.S. PATENT DOCUMENTS

| | | | | |
|---|---|---|---|---|
| 2,749,681 | A * | 6/1956 | Reidenbach | 451/527 |
| 2,979,867 | A * | 4/1961 | Beaver | 451/278 |
| 4,776,402 | A * | 10/1988 | Meikle et al. | 168/48.2 |
| 5,287,662 | A * | 2/1994 | Weis et al. | 451/527 |
| 5,645,469 | A * | 7/1997 | Burke et al. | 451/41 |
| 6,312,325 | B1 * | 11/2001 | Van Osenbruggen | 451/548 |
| 6,736,712 | B1 * | 5/2004 | Horn | 451/359 |
| 6,758,732 | B1 * | 7/2004 | Hilton | 451/360 |

* cited by examiner

*Primary Examiner*—Maurina Rachuba
(74) *Attorney, Agent, or Firm*—Thomas I. Rozsa

(57) ABSTRACT

A grinding or polishing machine or device having a grinding or polishing disc for grinding or polishing a work piece for the condition of the work piece placed against the lower surface of the grinding or polishing disc. The grinding or polishing disc has a plurality of slots extending therethrough to allow visual inspection of the work piece during the grinding or polishing operation.

9 Claims, 16 Drawing Sheets

FIG. 3
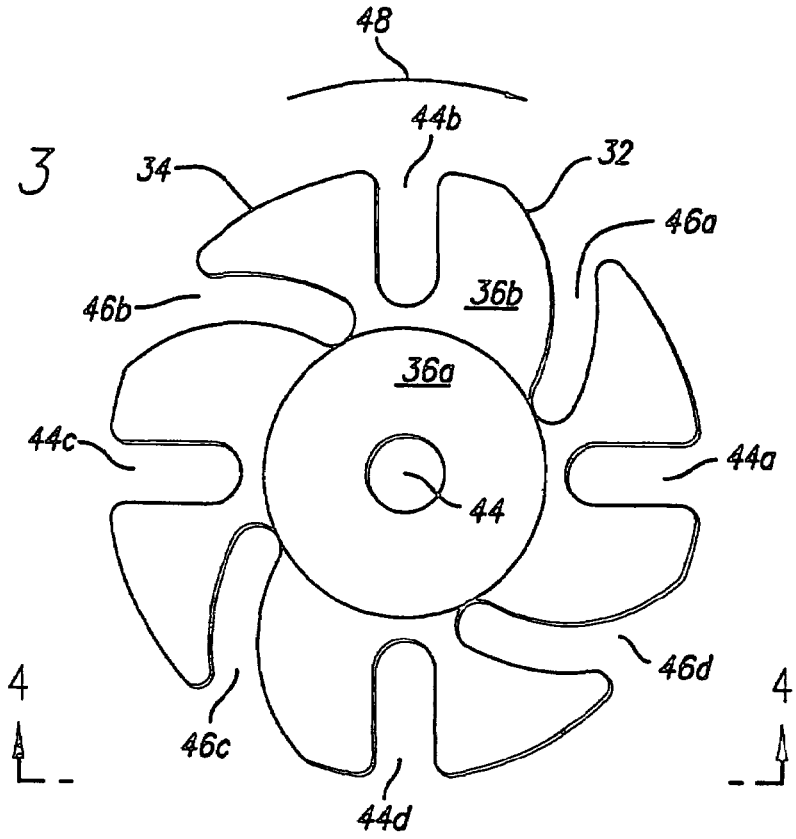
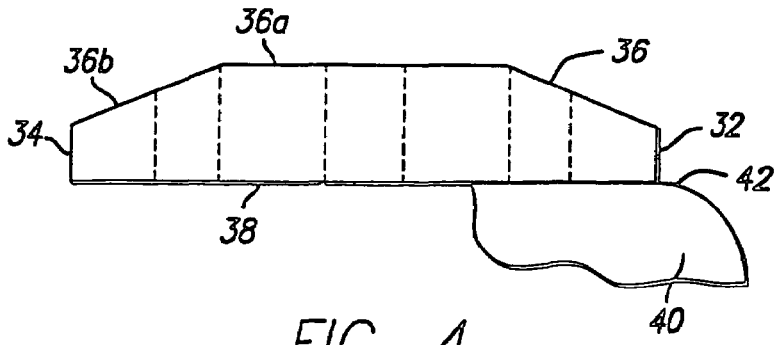
FIG. 4
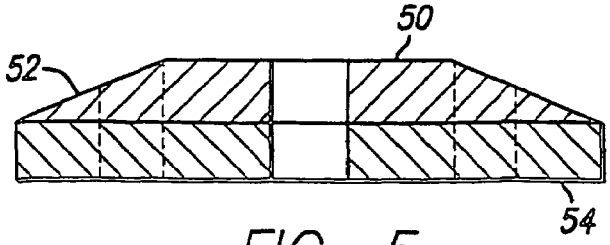
FIG. 5

GRINDING OR POLISHING ARRANGEMENT

This application is a divisional application of the continuation patent application of parent patent application Ser. No. 10/062,930 filed Jan. 30, 2002, now abandoned.

BACKGROUND OF THE INVENTION

1. Field of the Invention

This invention relates to the grinding and polishing art and more particularly to an improved combination of motor driven shaft having a particularly configured grinding or polishing disc mounted on the outer end thereof and an exhaust duct or hood in particle removing relationship thereto.

2. Description of the Prior Art

Many forms of grinding and polishing machines and devices have been utilized in the past in a wide variety of applications. And, in general, all such grinding or polishing machines or devices incorporate a rotating grinding or polishing disc against which a work piece that is to be ground or polished is positioned. Some of the machines or devices are fully automated; some are hand held devices; and some utilize a manual positioning of a work piece against the rotating grinding or polishing disc. In general, such grinding or polishing machines in which the work piece was manually positioned against the rotating grinding or polishing disc were characterized in that the generally comprised a housing in which an electrically powered motor was installed. The motor rotated a vertically output shaft and on the remote end of the output shaft there was mounted the grinding or polishing disc. The work piece to be ground or polished was generally placed against the under side of the disc and the grinding or polishing was commenced on the surface of the work piece. As the grinding or polishing continued, dust or particulate matter was generated by the abrasion of the grinding or polishing disc on the work piece. A hood or duct was placed in close relationship to the work piece and the hood or duct had an opening into which the dust or participate matter was conducted to be removed to regions spaced from the grinding or polishing machine. In many applications, a vacuum generating pump or device was connected to the remote end of the duct to aid in the removal of the dust or particulate matter.

Such devices had several disadvantages. Since the work piece was located under the rotating disc to be placed against the underside thereof, the view of the wok piece was often obstructed by the disc. Some prior art discs had a few, narrow radial apertures in regions adjacent the outer periphery of the disc and a small portion of the work piece was visible therethrough during the grinding or polishing operation. However, very often the work piece was removed from engagement with the disc at various times in order to inspect the condition of the work piece and then the work piece was replaced in the grinding or polishing relationship to the underside of the grinding or polishing disc. Further, the exhaust duct or hood was often not located in the position with respect to the work piece to allow efficient removal of the dust or particulate matter.

Accordingly, there has long been a need for a grinding or polishing machine in which more of the surface of the work piece that is being ground or polished may be visible and in which a larger portion of the dust or particulate matter generated during the grinding or polishing operation may be removed.

SUMMARY OF THE INVENTION

It is an object of the present invention to provide an improved grinding or polishing machine.

It is another object of the present inventions to provide an improved grinding or polishing machine in which the work piece is more clearly seen during the grinding or polishing operation.

It is yet another object of the present invention to provide a grinding or polishing machine that allows for removal of a large percentage of the dust or particulate matter generated during the grinding or polishing operation.

The above and other objects of the present invention are achieved, according to a preferred embodiment of the present invention by providing a housing or case in which a motor and, if necessary, a gear box are located. The motor is oriented to rotate a generally vertically aligned shaft. The alignment of the shaft may be perpendicular to the base on which the grinding or polishing machine is placed or it may be at a preselected angle thereto. The shaft projects through a top seal plate that closes the top of the housing or case to prevent the entrance of dust or particulate matter into the interior of the housing or case.

A grinding or polishing disc is coupled to the remote end of the shaft and rotates therewith. According to the present invention, the grinding or polishing disc has a plurality of cuts or slots having a predetermined pattern and extending therethrough from the upper surface thereof to the lower surface thereof. The predetermined pattern is selected to allow greater visibility of the work piece through the disc during the grinding or polishing operation than has heretofore been available with prior art grinding or polishing discs and still have the disc with sufficient structural integrity to withstand the intended grinding or polishing operation. That is, since there are a very large variety of materials from which the work piece may be fabricated, a work piece that does not require great force to be used in keeping the work piece in contact with the underside of the disc during the grinding or polishing operation, the cuts or slots may be more extensive than for a work piece that requires a comparatively great force to hold it against the grinding or polishing disc.

The grinding or polishing disc has a generally circular peripheral edge. The upper surface of the grinding or polishing disc may have a central portion that is planar and a tapered portion extending from the central portion to the peripheral edge. The bottom surface of the grinding or polishing disc is generally planar and extends to the peripheral edge. In the preferred embodiments of the present invention the peripheral edge has a predetermined axial thickness so that there is structural support for the grinding or polishing operation throughout the radial extent of the grinding or polishing disc. The grinding or polishing disc may be fabricated from a unitary grinding or polishing material or the grinding or polishing disc may be a laminate. In the embodiments of the present invention wherein there is a laminate disc, there may be provided a substrate or base member of metal or other rigid material and on the bottom surface thereof is deposited the grinding or polishing material.

The grinding or polishing discs of the present invention may also have utility in grinding or polishing devices other than the particular grinding or polishing machine described herein. That is, the grinding or polishing disc may be mounted on a hand held grinding or polishing device, on automated grinding or polishing machines or the like. Thus, the particular shape and contours of the grinding or polishing disc as described herein may be selected based on the particular type of device on which it is to be installed, the type of material from which the work piece is fabricated, and the like. Those skilled in the grinding or polishing art may readily select the particular disc most appropriate for a given application.

An upstanding exhaust duct or hood extends around the periphery of the housing or case and has an axial extent that is greater than the axial position of the grinding or polishing disc to prevent the dust or particulate matter from being deposited in regions around the grinding or polishing machine. There is provided an opening in the duct or hood sufficiently large to allow the work piece to be moved into and out of engagement with the grinding or polishing disc. The duct or hood has an exhaust passage that is oriented in dust or particulate matter receiving relationship to the grinding or polishing disc. The location of the exhaust passage is selected to be in the location that the maximum amount of dust or particulate matter is directed from the grinding or polishing disc into the exhaust passage during the grinding or polishing operation. Thus, the location of the entrance to the exhaust passage determines the optimum location for the placing of the work piece on the bottom surface of the grinding or polishing disc.

BRIEF DESCRIPTION OF THE DRAWINGS

The above and other embodiments of the present invention may be more fully understood from the following description taken together with the accompanying drawing wherein similar reference characters refer to similar element and in which:

Referring particularly to the drawings for the purpose of illustration only and not limitation, there is illustrated:

FIGS. 1, 1A and 2 illustrate a grinding or polishing machine according to the principles of the present invention;

FIG. 3 illustrates a grinding or polishing disc useful in the practice of the present invention;

FIG. 4 is a view along the line 4-4 of FIG. 3;

FIG. 5 is a sectional view of another embodiment of a grinding or polishing disc useful in the practice of the present invention;

DETAILED DESCRIPTION OF THE PREFERRED EMBODIMENTS

Figure 1:
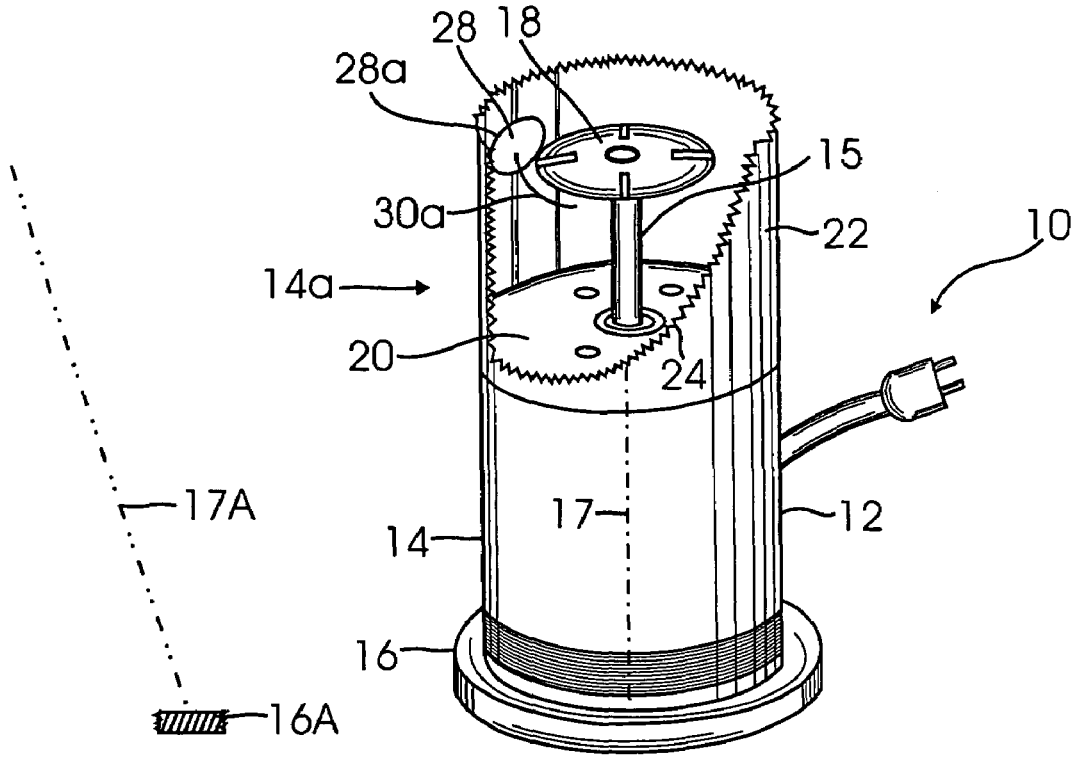

Referring now to the drawings there is illustrated an embodiment 10 of a grinding or polishing machine generally designated 12 according to the principals of the present invention. The invention herein is illustrated in the drawing in embodiment 10 as the type of grinding or polishing machine in which a work piece is held against the bottom surface of a rotating grinding or polishing disc and the grinding or polishing machine is stationary during the grinding or polishing operation. However, the invention herein may be utilized in many other applications.

Figure 2:
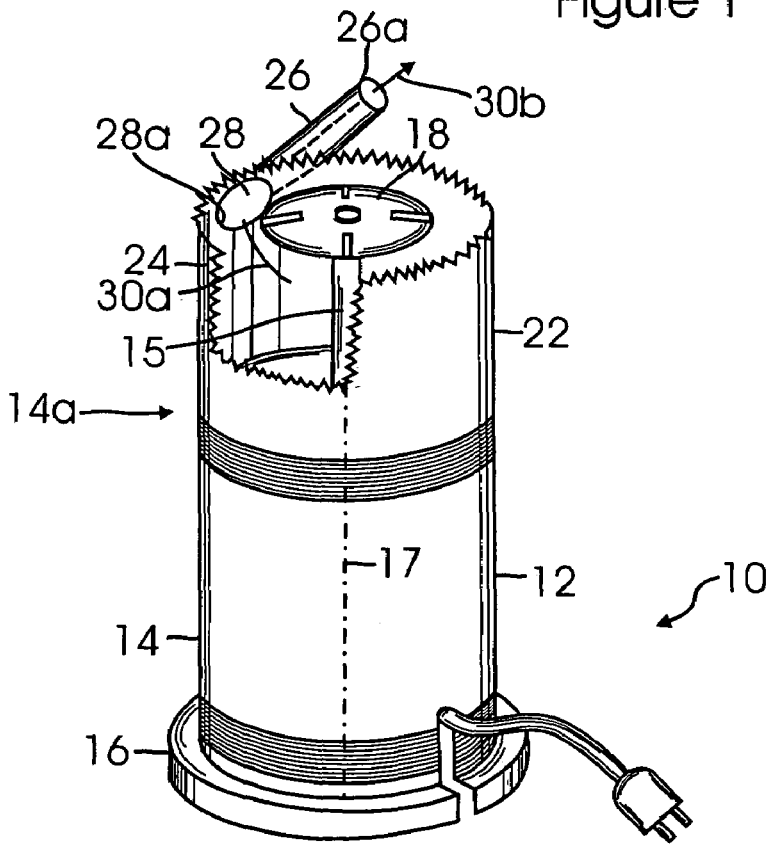

The grinding or polishing machine 12 of embodiment 10 has a housing 14 and a base 16 which supports the embodiment 10 in a generally upright or vertical position. The generally upright position may be such that a shaft 15 upon which a grinding or polishing disc 18 is mounted for rotation therewith about axis 17 is aligned vertically, that is perpendicular to the base 16, as illustrated in FIG. 1 and FIG. 2, or at an angle to the vertical or base 16 as illustrated in FIGS. 1A. The housing 14 defines a cavity therein and contains in the cavity an electrically powered motor (not shown) of conventional design for rotating the shaft 16 and grinding or polishing disc 18. If desired, a gear box (not shown) may also be contained in the cavity defined by the housing 14 to increase or decrease the rotational speed of the motor and, consequently, the rotational speed of the grinding or polishing disc 18. The gear box may also be of conventional design. The motor may be a constant speed or a variable speed motor as desired for particular applications. The shaft 15 passes through a top seal plate 20 that is coupled to the housing 14 and is provided to prevent the entry of dust or particulate matter into the ulterior of the housing 14.

The disc 18 shown on FIGS. 1 and 2 is a circular grinding or polishing disc of conventional design known in the prior art and, as shown, has four radial slots extending from the periphery of the grinding or polishing disc 18 a predetermined distance toward the center thereof. Such slots are utilized as viewing apertures to allow viewing of a work piece (not shown) pressed against the bottom surface of the disc 18 for the grinding or polishing operation.

A duct or hood 22 is positioned on the top portion 14*a* of housing 14 and generally surrounds the upper portion 14*a* and the disc 18. An opening 24 in the duct or hood 22 is provided to allow access to the disc 18 during the grinding or polishing operation. The upstanding walls 22*a* of the duct or hood 22 preferably extend a sufficient distance over the upper portion 14*a* of the duct or hood 14 to prevent the dust or particulate matter generated during the grinding or polishing operation from being widely dispersed into regions outside the general location of the grinding or polishing machine 12. An exhaust passage 26 is provided on the duct or hood 22 and dust or particulate matter generated during the grinding or polishing operation are directed into aperture 28 defined by wall portions 28*a* and flows through the exhaust passage in the directions indicated by the arrows 30*a* and 30*b*. A vacuum pump (not shown) may be connected to the remote end 26*a* of the exhaust passage 26 to aid in the removal of the dust or particulate matter flowing in the directions of the arrows 30*a* and 30*b*. The aperture 28, therefore, determines the optimum position for placing a work piece against the disc 18 so that the largest amount of dust or particulate matter generated is removed through the exhaust passage 26. The duct or hood 22 may be of any desired configuration that meets the functional requirements as aforesaid. However, in order to improve the aesthetic appearance of the grinding or polishing machine 12, the duct or hood may be ornamental in appearance. The ornamental appearance defined by the duct or hood shown in co-pending design patent application Ser. No. 29/154,008, filed Jan. 16, 2002, now U.S. Pat. No. D466,536, may be incorporated into the design of the duct or hood 22 so that the overall appearance of the grinding or polishing machine 12 is enhanced.

As noted above, the grinding or polishing disc 18 shown in FIGS. 1 and 2 is in the configuration of the prior art grinding or polishing discs with just four radial slots extending from the periphery towards the center. Such small slots did not permit adequate viewing of the work piece during the grinding or polishing operation. Therefore, in accordance with the principals of the present invention, improved grinding or polishing discs are provided that permit a much greater viewing of the work piece during the grinding or polishing operation.

Referring now to FIGS. 3 and 4, there is shown a grinding or polishing disc that, according to the principals of the present invention, allows much greater viewing of the work piece during the grinding or polishing operation. The disc 32 has a peripheral edge 34 that is generally circular in shape. The disc 32 also has an upper surface 36 and a lower surface 38. The lower surface 38 is the surface which performs the grinding or polishing operation when a work piece as indicated at 40 is pressed thereagainst so that the upper surface 42 thereof may be ground or polished as desired. The upper surface 36 of disc 32 has a generally planar portion 36*a* surrounding the central aperture 44 through which the shaft 16 (FIG. 1 and FIG. 2) passes and which allows the disc 32 to be coupled thereto for rotation therewith. The upper surface 36 of disc 32 also has a tapered portion 36*b* which extends from the planar portion 36*a* to the peripheral edge 34. In preferred embodiments of the present invention, the peripheral edge has a predetermined axial extent so that there is sufficient structural integrity of the disc 32 at the peripheral edge 34 to withstand the forces involved in the grinding or polishing operation. In order to allow greater viewing of the work piece 40 during the grinding or polishing operation, there are provided a plurality of apertures in the disc 32 extending from the upper surface 36 to the lower surface 38. In addition to the four radial extending slots 44*a*, 44*b*, 44*c* and 44*d*, which may be similar to the slots shown in the grinding or polishing disc 18 (FIG. 1 and FIG. 2) there are provided the four generally arcuate slots 46*a*, 46*b*, 46*c* and 46*d*. As the disc 32 rotates, for example in the direction indicated by the arrow 48, the upper surface 42 of work piece 40 is visible through the slots 44,46 to a much greater extent than the visibility provided by the slots 44 alone. The size and extent of the slots 44,46 are selected with consideration of the nature of the work piece 40. Since greater force may be required for the condition of the work piece 40 being, for example, a hard metal such as steel, cast iron or the like, a greater axial thickness of the disc 32 between the upper surface e 36 and lower surface 38 may be required and/or the extent of the slots 44,46 may be less than for the condition where the work piece 40 is of a softer material.

The grinding or polishing disc 32 is a substantially homogeneous material: an abrasive material suitable for the desired grinding or polishing operation. However, it has been found that in many applications it may be desirable to provide a grinding or polishing disc having a rigid substrate or base layer upon which the desired grinding or polishing material may be deposited or otherwise secured to the lower surface thereof. FIG. 5 illustrates a cross sectional view of a grinding or polishing disc 50 which is generally similar to the disc 32 of FIG. 3 and 4 except that the disc 50 has a rigid, for example metal, substrate or base layer 52 upon which a grinding or polishing material 54 is deposited.

The configuration of the slots provided in th grinding or polishing discs of the present invention are not limited to those depicted in FIG. 3 and FIG. 4. Rather, there may be provided a plurality of slots in a very large, almost limitless number of configurations and combinations. The slots incorporated in the various grinding or polishing discs of the present invention may be generally defined for convenience of description as to the geometrical shape thereof as, arcuate, linear, oval or circular and in any combination of such shaped slots. However, the exact geometrical configuration may be other than the precise mathematical definition. The slots may extend in radial directions, circumferential directions or other directions in the grinding or polishing disc. The slots extend through the disc to allow the viewing of the work piece during the grinding or polishing operation.

Figure 6:
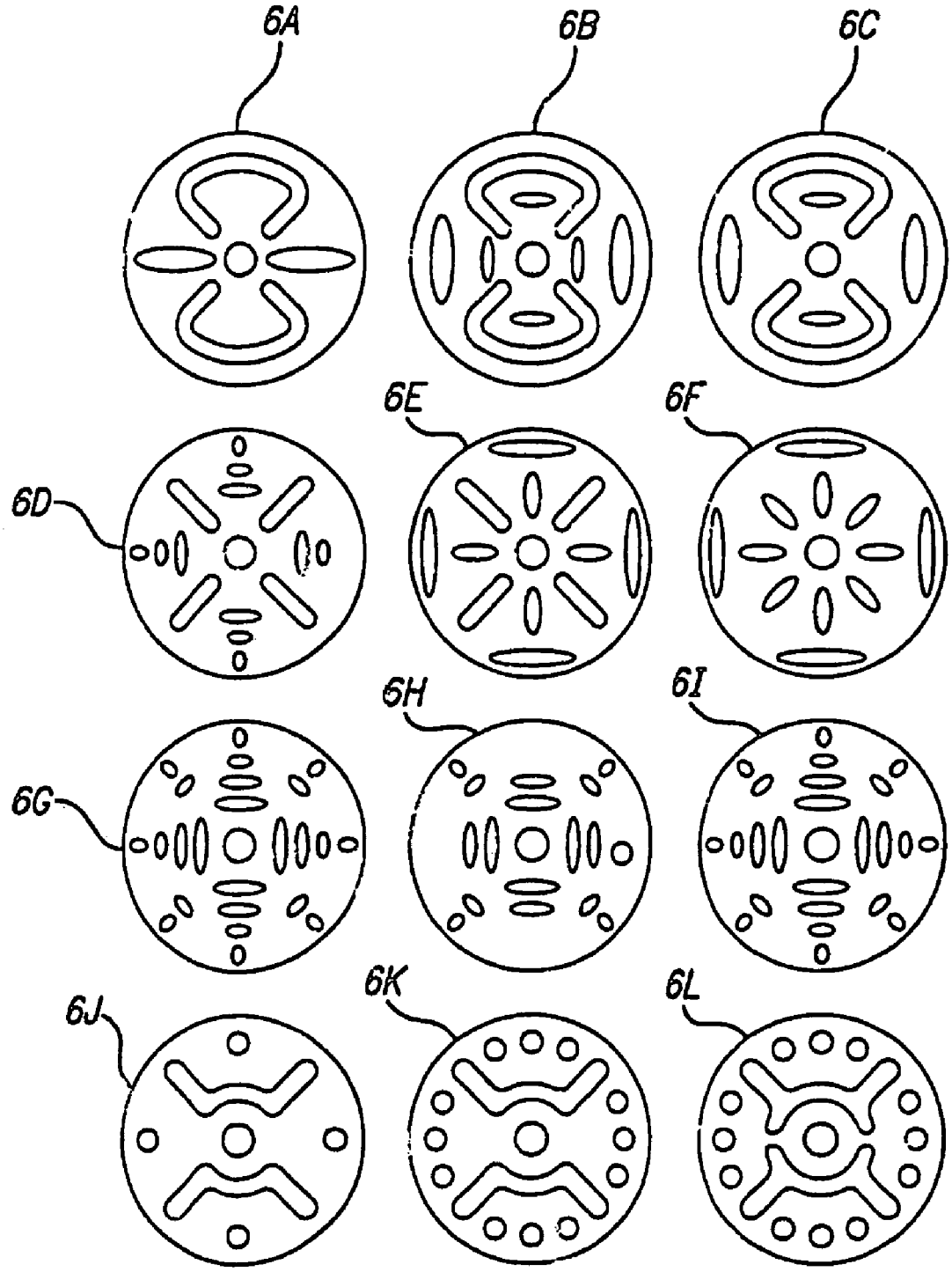
FIGS. 6A through 6L illustrate other grinding or polishing discs useful in the practice of the present invention.

FIG. 6 illustrates grinding or polishing discs of FIGS. 6A through 6L and none of the discs 6A through 6L have any radial extending slots at the peripheral walls thereof.

Figure 7:
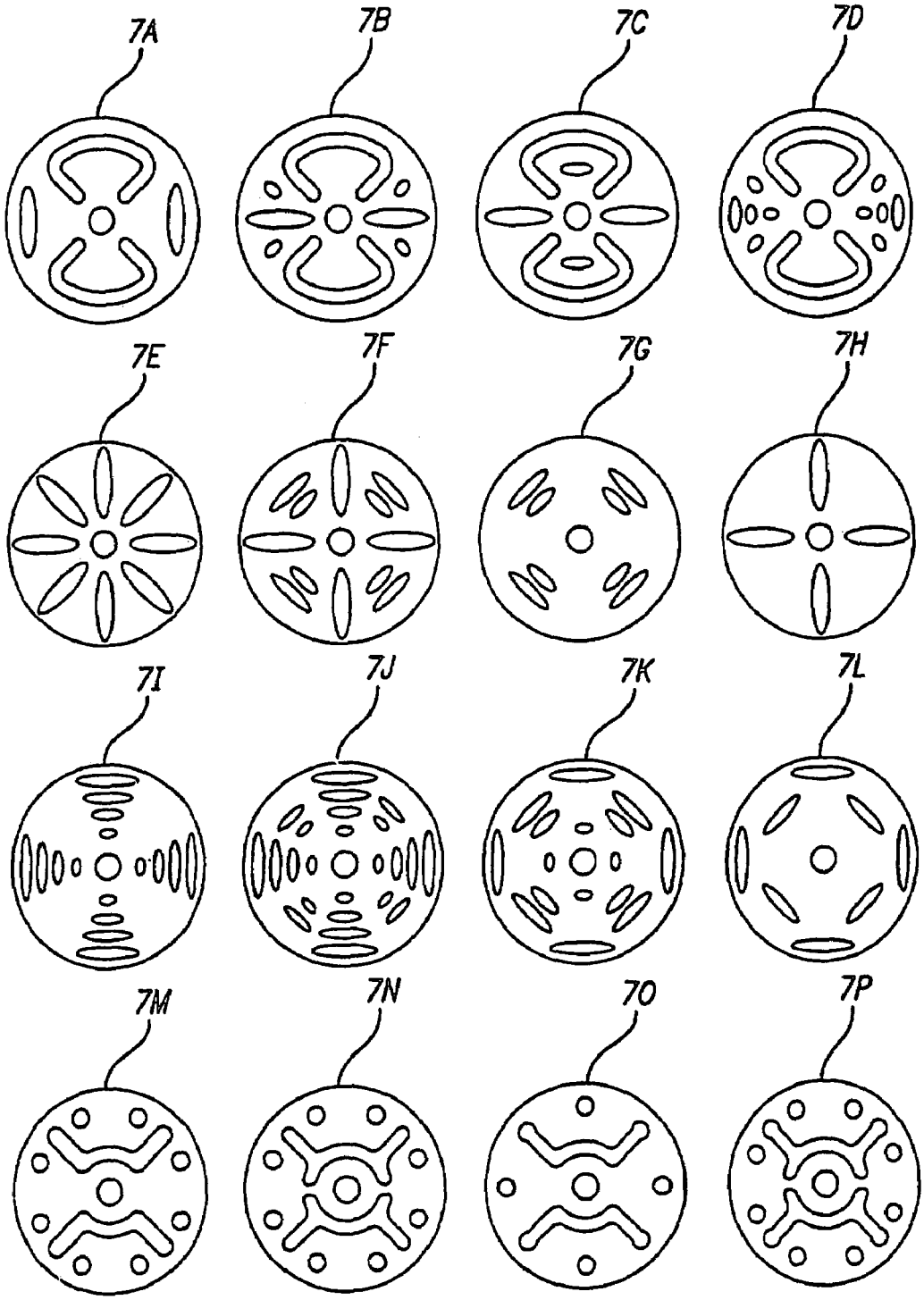
FIGS. 7A through 7P illustrate other grinding or polishing discs useful in the practice of the present invention.

FIG. 7 illustrates grinding or polishing discs of FIGS. 7A through 7P in yet more configurations of the slots extending therethrough and none of the discs of FIG. ? A through 7P have any radial slots at the peripheral edge thereof.

Figure 8:
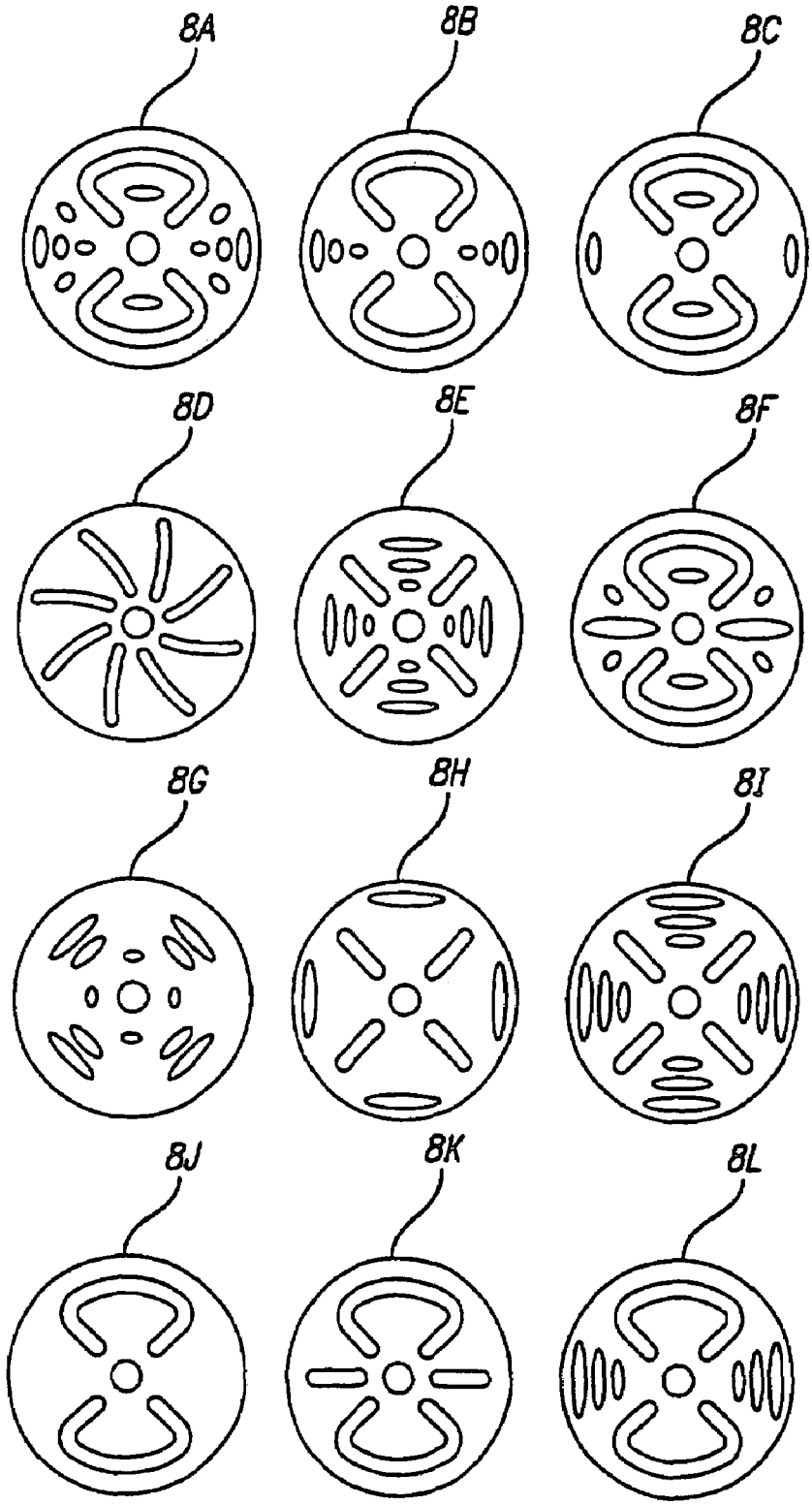
FIGS. 8A through 8L illustrate other grinding or polishing discs useful in the practice of the present invention.

FIG. 8 illustrates grinding or polishing discs 8A through 8L having yet other combinations of slots therethrough and free of radially extending slots at the peripheral edges thereof.

Figure 9:
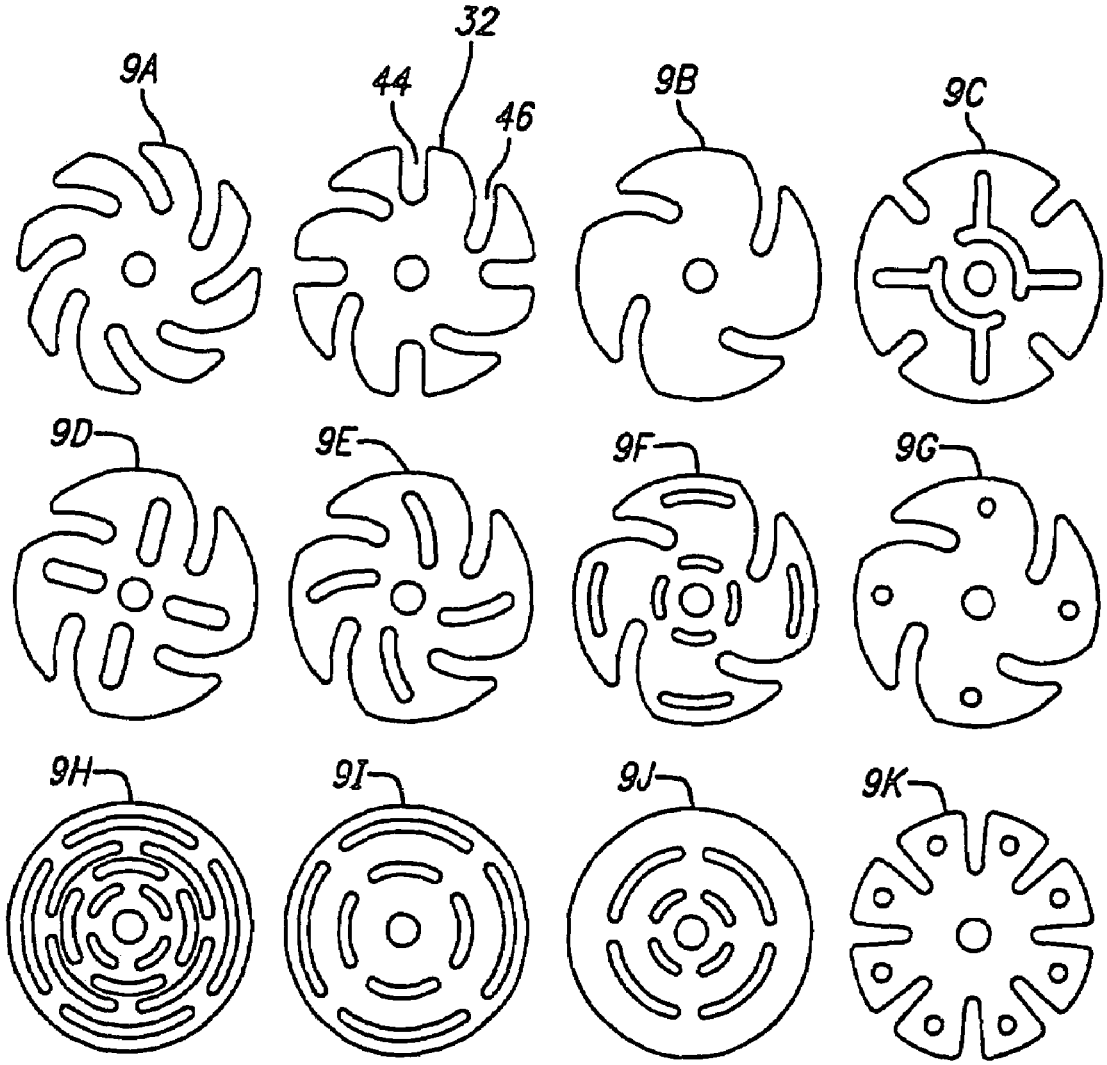
FIGS. 9A through 9K illustrate other grinding or polishing discs useful in the practice of the present invention.

FIG. 9 illustrates grinding or polishing discs 9A through 9K, as well as. the disc 32 of FIG. 3 and FIG. 4. The grinding or polishing discs of FIGS. 9A, 9B, 9D, 9E 9F and 9G all incorporate the arcuate slots at the peripheral edges thereof similar to the arcuate slots 44 of grinding or polishing disc 32. FIG. 9C illustrates a grinding or polishing disc with radial slots at the peripheral edge and other slots having both arcuate and linear portions. FIGS. 9H, 9I and 9J show grinding or polishing discs having all arcuate slots concentric with the central apertures thereof. FIG. 9K illustrates a grinding or polishing disc having tapered radially extending slots at the peripheral edge and a plurality of circular slots.

Figure 10:
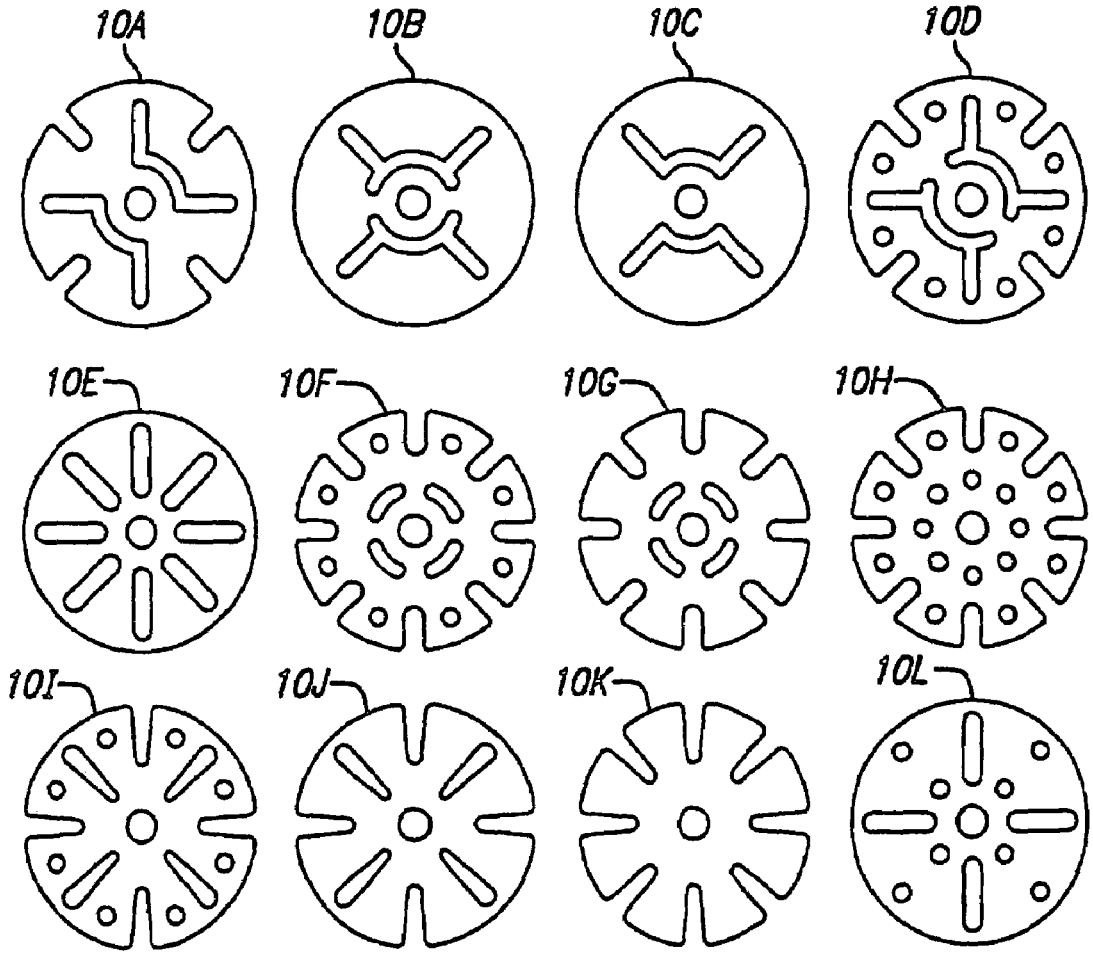
FIGS. 10A through 10L illustrate other grinding or polishing discs useful in the practice of the present invention.

FIG. 10 illustrates grinding or polishing discs 10A through 10L having still other combinations of radial, linear, arcuate, circular and oval slots.

Figure 11:
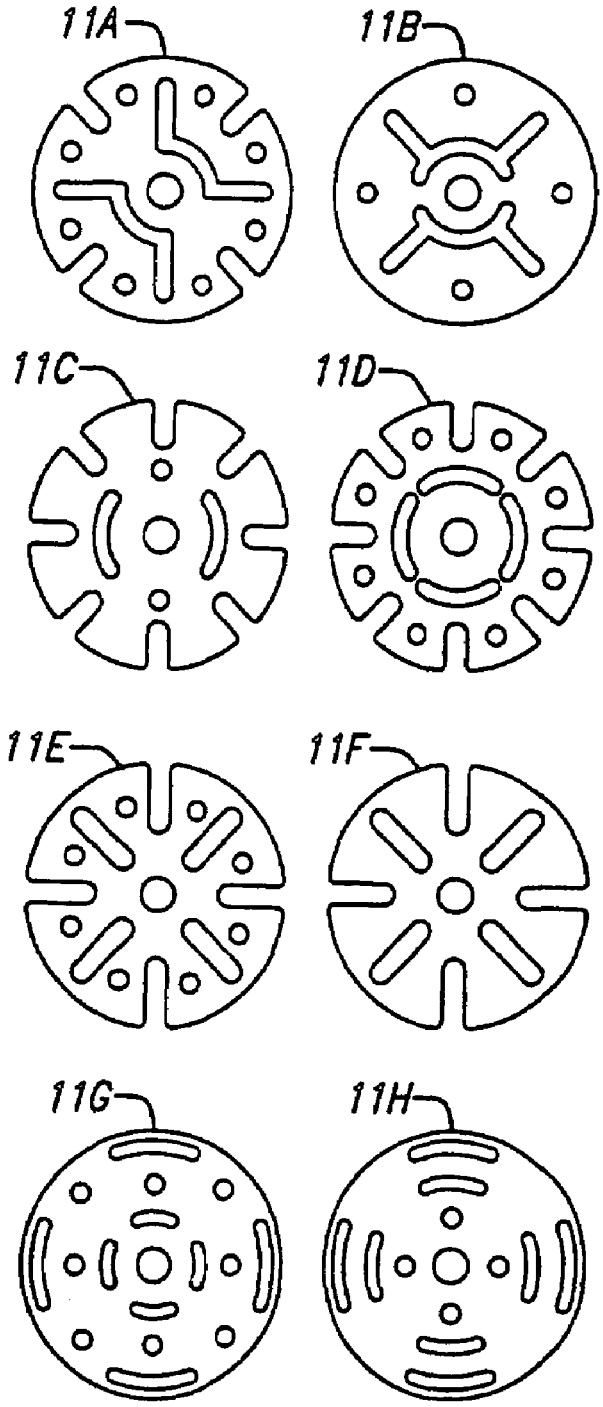
FIGS. 11A through 11H illustrate other grinding or polishing discs useful in the practice of the present invention.

FIG. 11 illustrates grinding or polishing discs 11A through 11H having still other combinations of radial, linear, arcuate, circular and oval slots.

Figure 12:
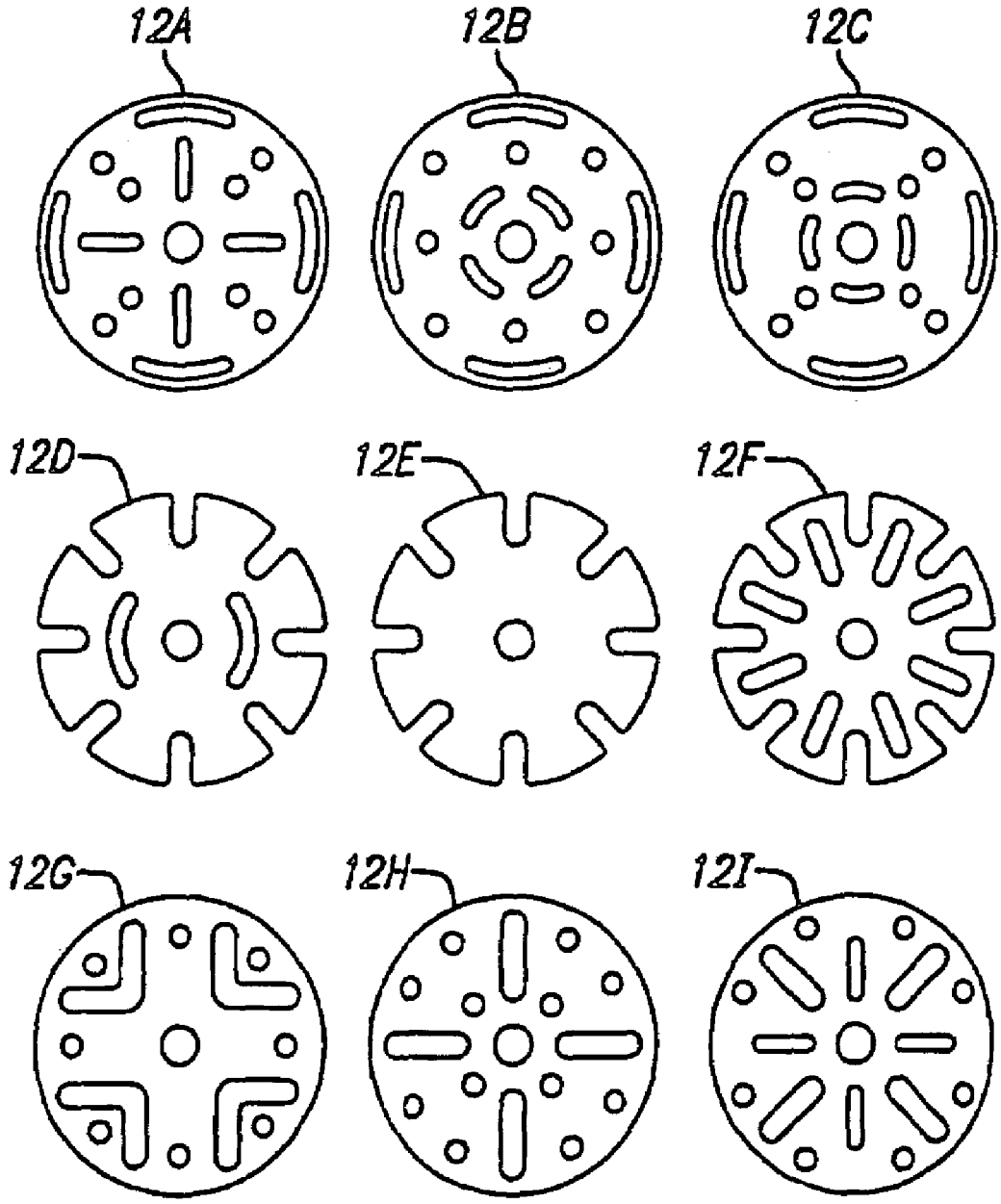
FIGS. 12A through 12L illustrate other grinding or polishing discs useful in the practice of the present invention.

FIG. 12 illustrates grinding or polishing discs 12A through 101 having still other combinations of radial, linear, arcuate, circular and oval slots.

Figure 13:
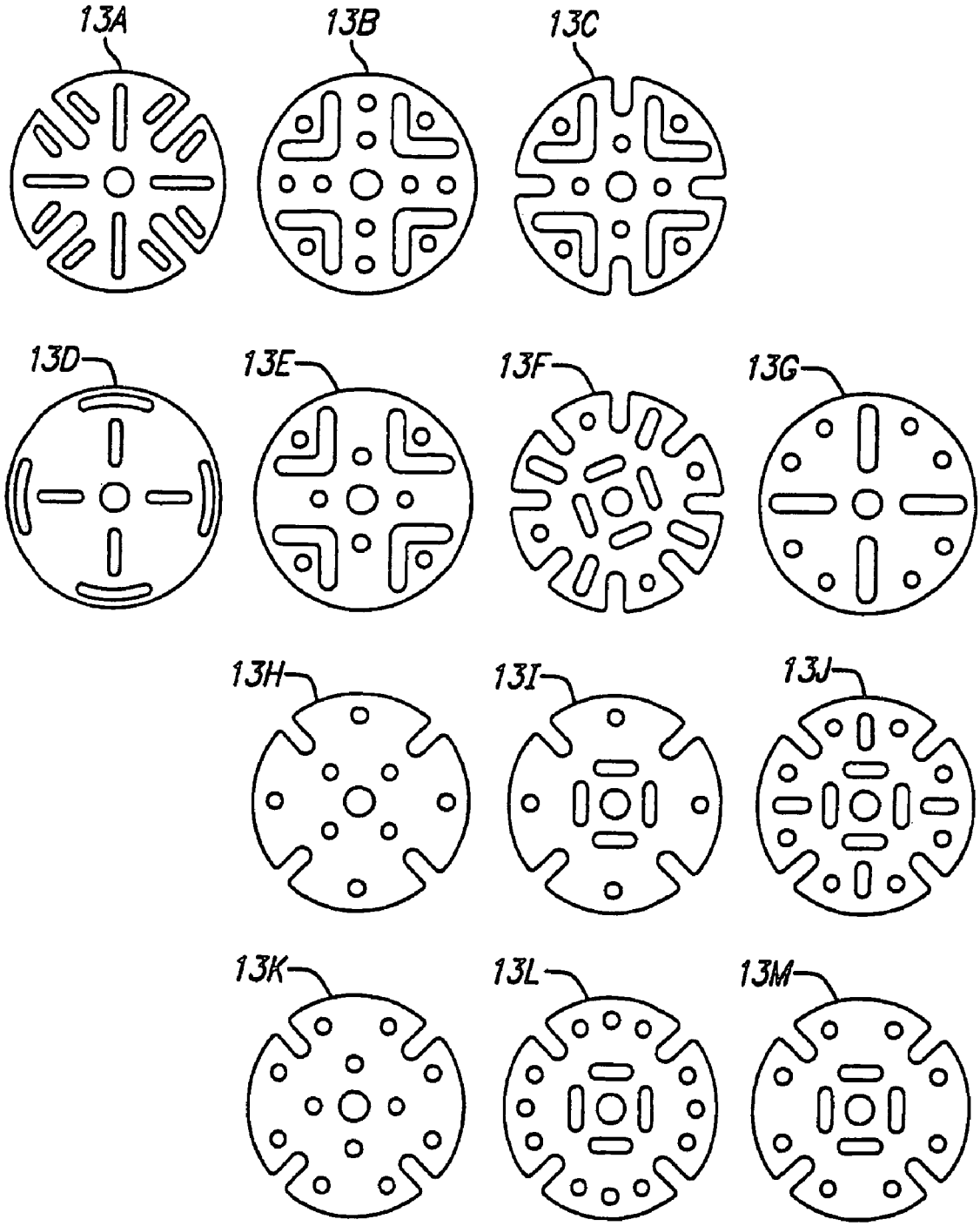
FIGS. 13A through 13M illustrate other grinding or polishing discs useful in the practice of the present invention.

FIG. 13 illustrates grinding or polishing discs 13A through 13*m* having still other combinations of radial, linear, arcuate, circular and oval slots.

Figure 14:
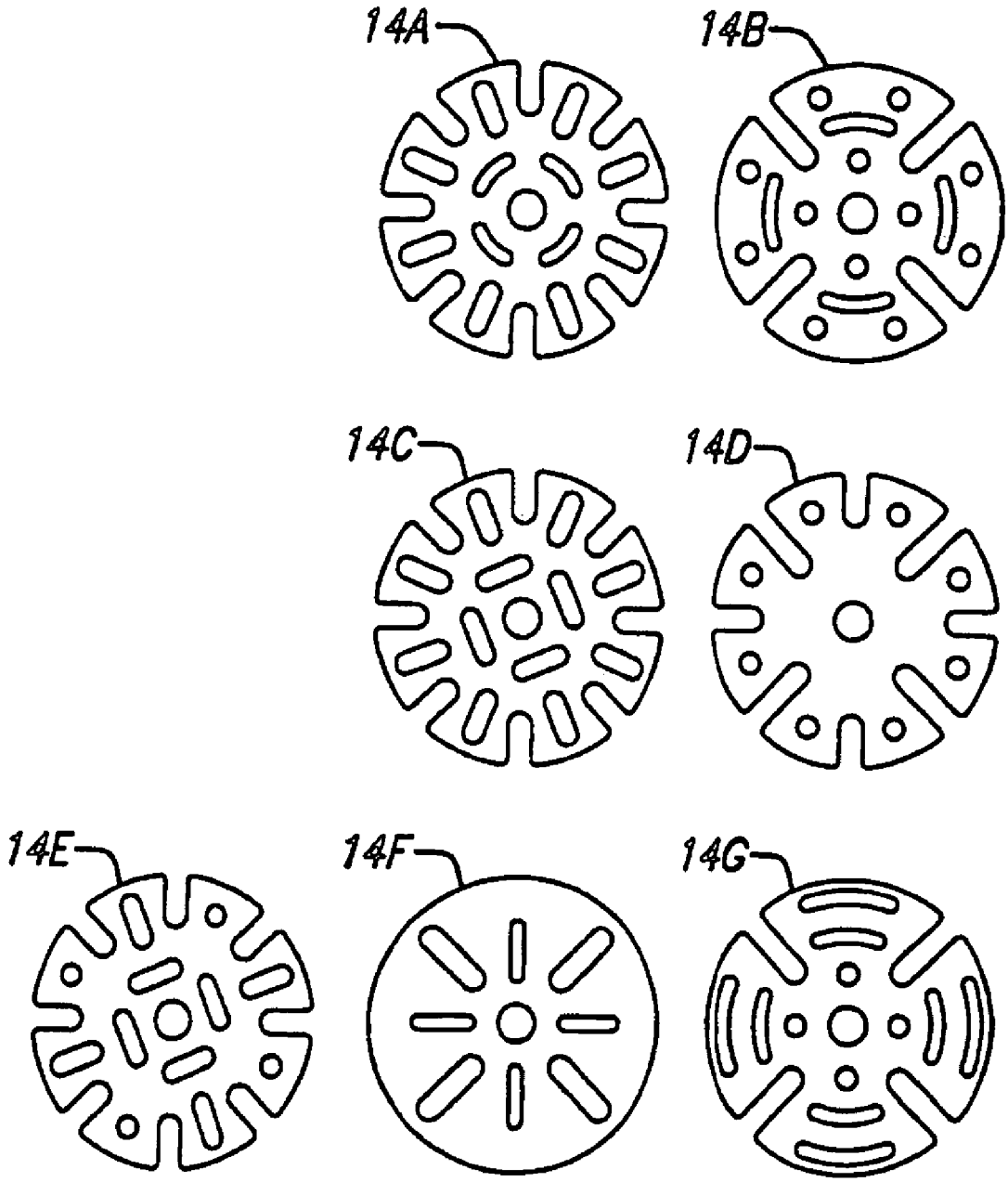
FIGS. 14A through 14G illustrate other grinding or polishing discs useful in the practice of the present invention.

FIG. 14 illustrates grinding or polishing discs 14A through 14G having still other combinations of radial, linear, arcuate, circular and oval slots.

Figure 15:
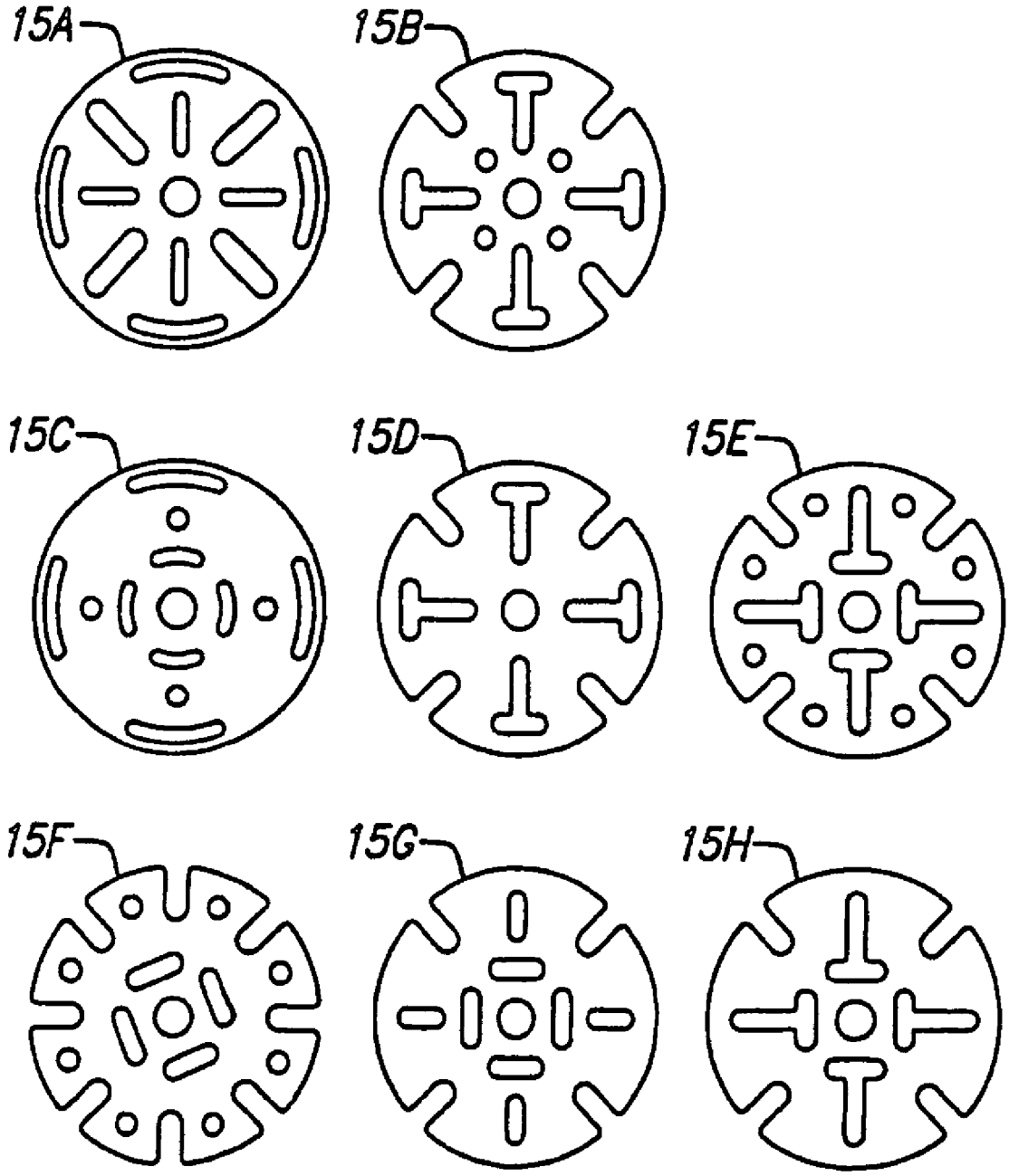
FIGS. 15A through 15H illustrate other grinding or polishing discs useful in the practice of the present invention.

FIG. 15 illustrates grinding or polishing discs 15 A through 15H having still other combinations of radial, linear, arcuate, circular and oval slots.

Figure 16:
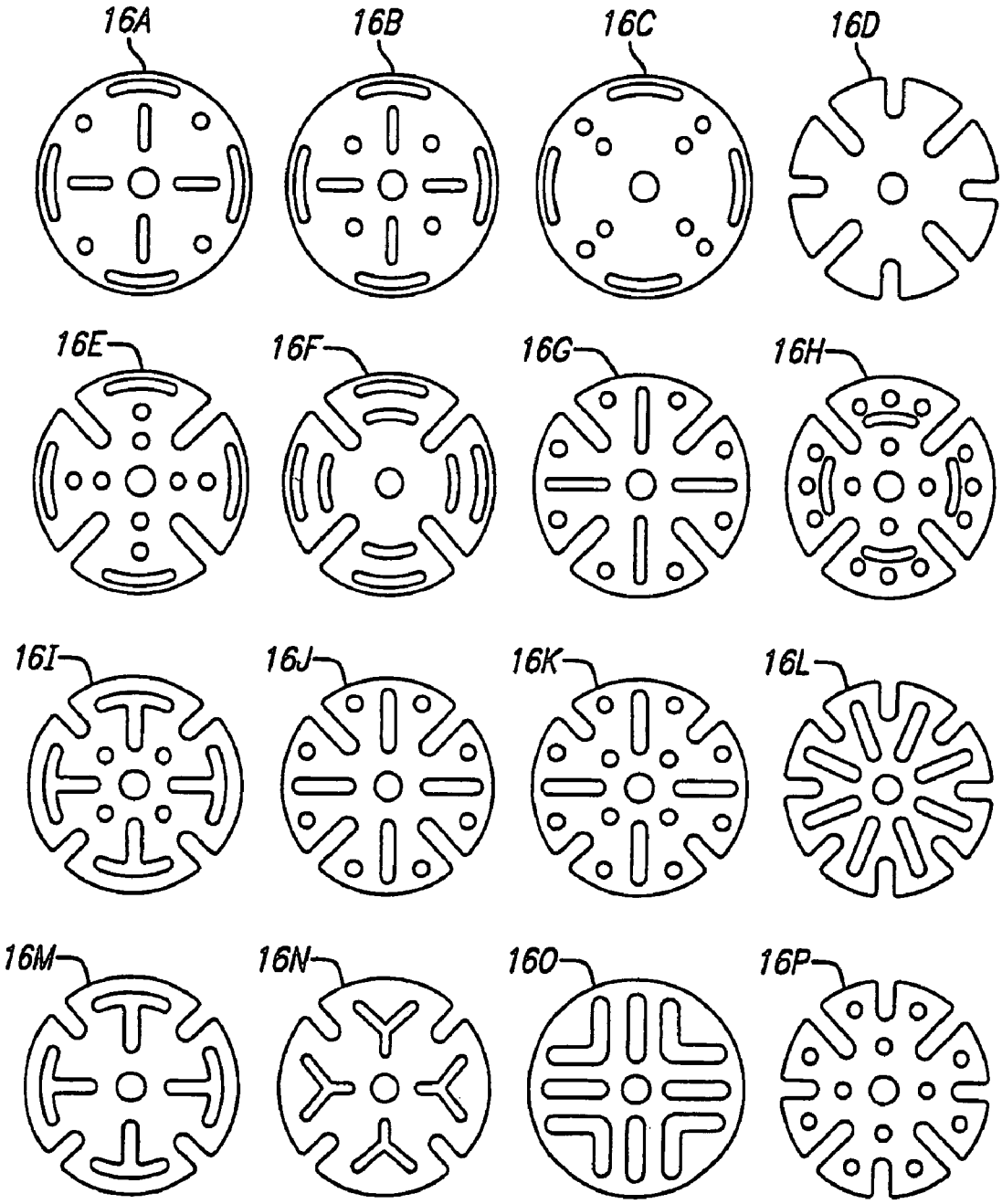
FIGS. 16A through 16P illustrate other grinding or polishing discs useful in the practice of the present invention.

FIG. 16 illustrates grinding or polishing discs 16A through 16P having still other combinations of radial, linear, arcuate, circular and oval slots.

Figure 17:
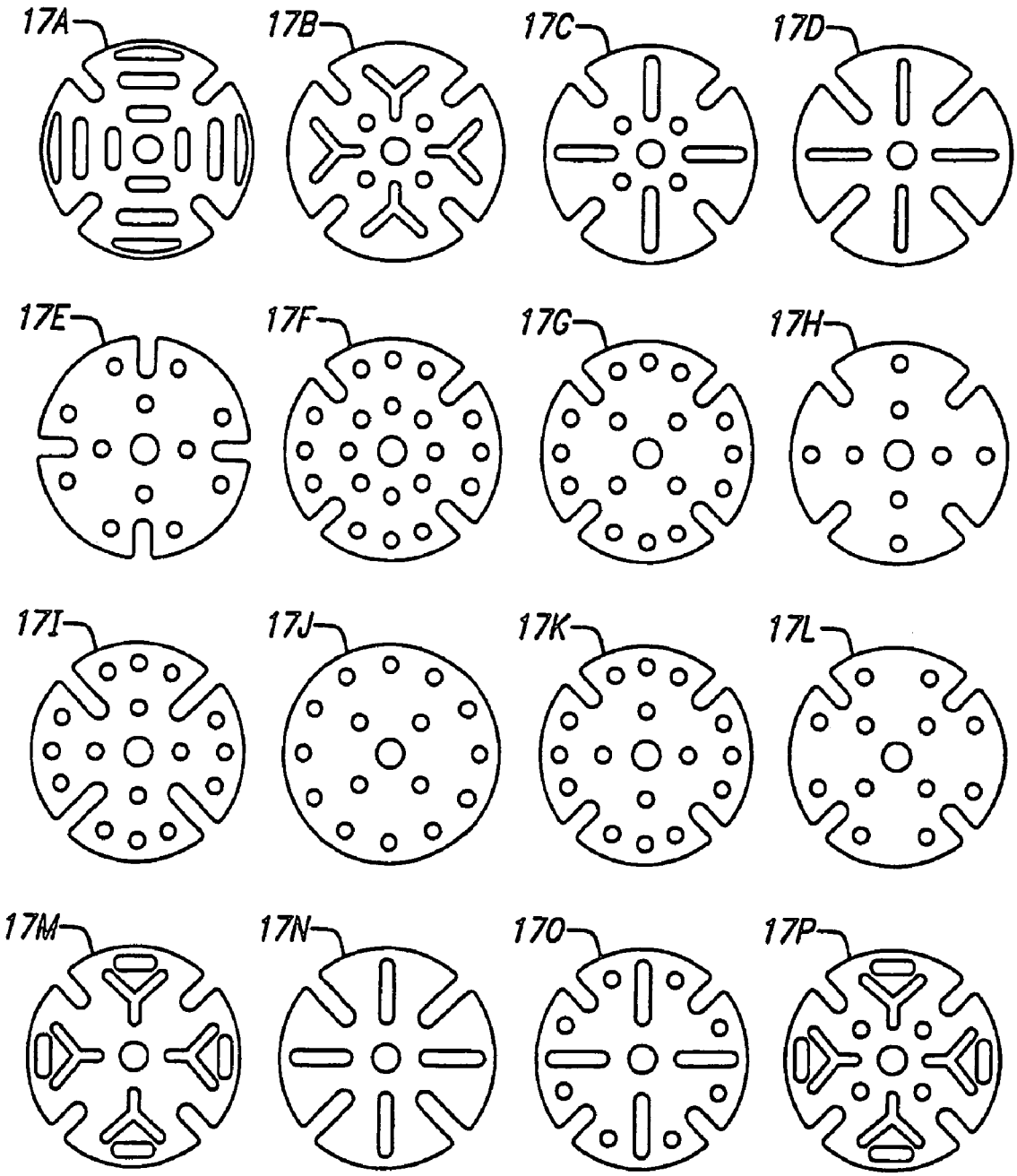
FIGS. 17A through 17P illustrate other grinding or polishing discs useful in the practice of the present invention.
Figure 18:
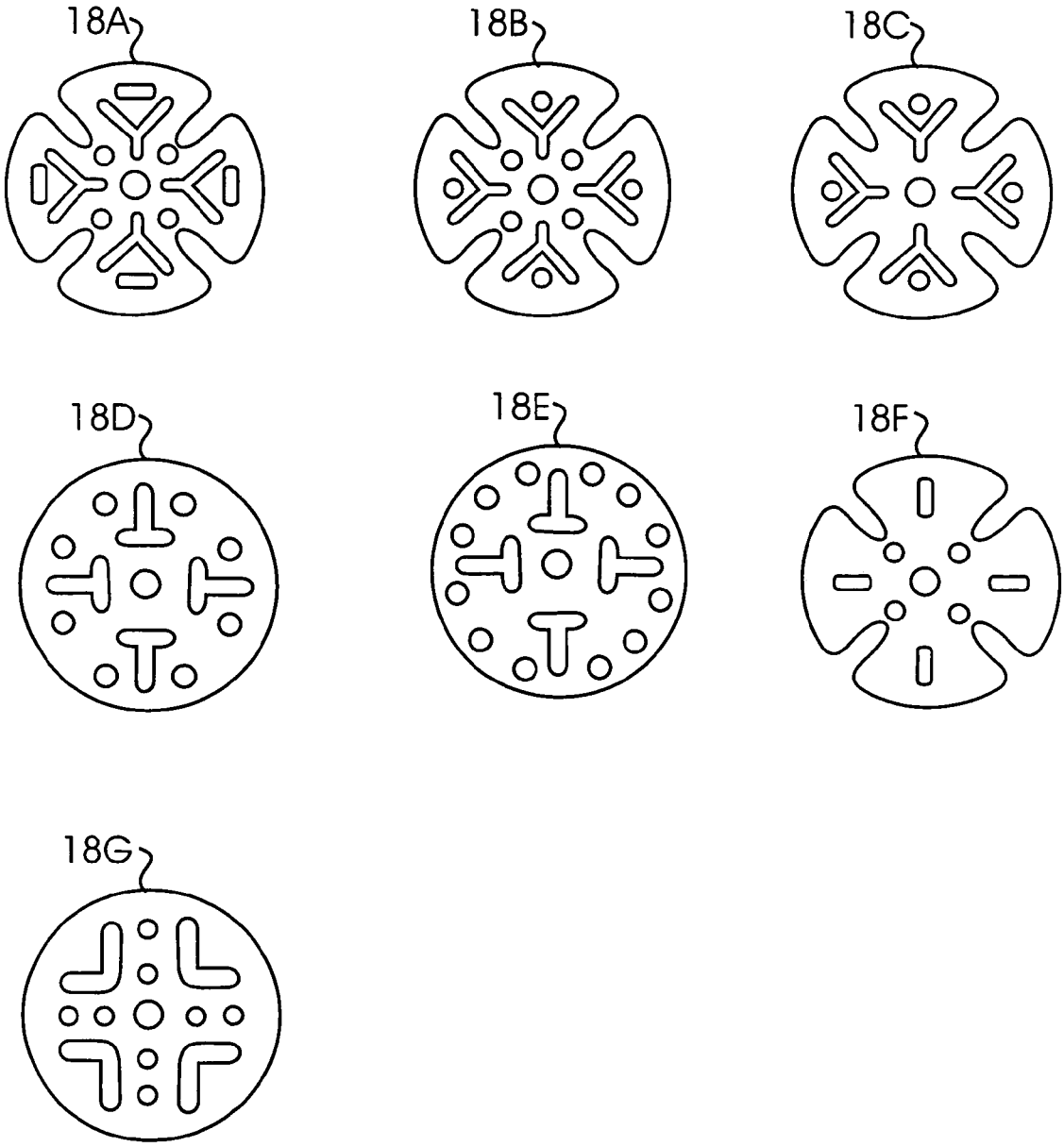
FIGS. 18A through 18G illustrate other grinding or polishing discs useful in the practice of the present invention.
Figure 19:
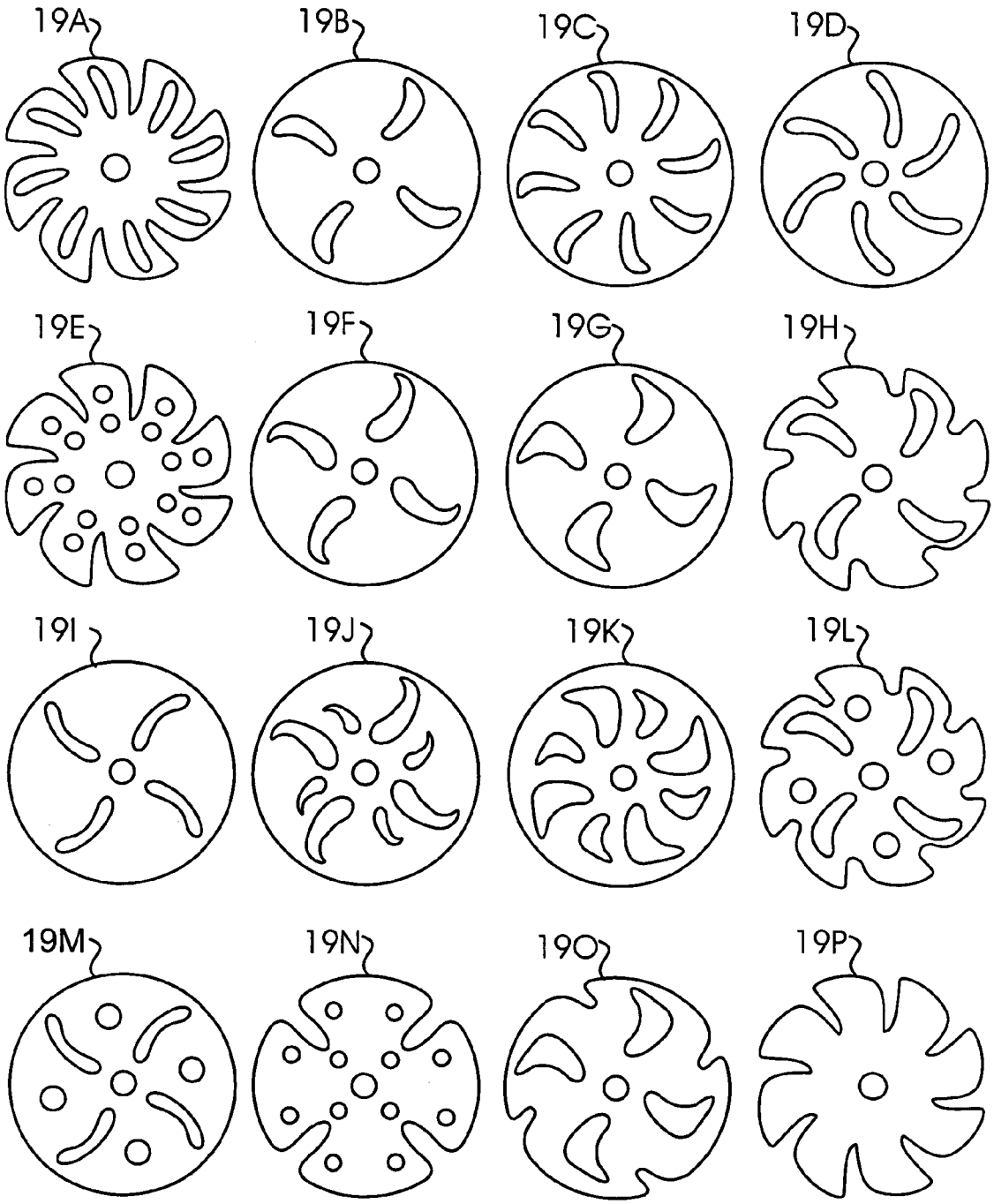
FIGS. 19A through 19P illustrate other grinding or polishing discs useful in the practice of the present invention.

FIG. 17 illustrates grinding or polishing discs 17A through 17P having still other combinations of radial, linear, arcuate, circular and oval slots FIG. 18 illustrates grinding or polishing discs 18A through 18G having still other combinations of radial, linear, arcuate, circular and oval slots FIG. 19 illustrates grinding or polishing discs 19A through 19P having still other combinations of radial, linear, arcuate, circular and oval slots Each of grinding or polishing discs depicted in FIGS. 6 through 19 may be fabricated of a homogeneous grinding material as shown in FIG. 3 and FIG. 4 or may be fabricated as a laminate with a rigid base and a thin layer of the grinding or polishing material deposited on the lower surface thereof. The upper surface may have a planar portion in regions adjacent the central aperture as depicted in FIG. 3 and FIG. 4 or the upper surface may be planar throughout the extent thereof. The particular combination of slots and the particular configuration of the slots may be selected depending upon the uses to which the grinding or polishing disc is to be put, the type of device into which the grinding or polishing discs are to be installed and the like. Those skilled in the art may select the desired combination of slots and configurations thereof as required for any given application.

This concludes the description of the invention herein. Those skilled in the art may find many other configurations, variations and adaptations of grinding or polishing discs in accordance with the teachings of the present invention and all such configurations, variations and adaptations falling within the scope and spirit of the appended claims are intended to be covered thereby.

What is claimed is:

1. An improved grinding or polishing disc of the type adapted to have a grinding or polishing material on a lower surface thereof comprising:

a. said grinding or polishing disc having an upper surface, a lower surface, and a center area, a central aperture in the center area extending from the upper surface to the lower surface, the central aperture enabling the disc to be coupled to a rotatable shaft for rotation therewith; and b. said grinding or polishing disc having a generally circular peripheral edge, the lower surface adapted to grind or polish the surface of a work piece, and having walls defining a multiplicity of slots extending through said grinding or polishing disc from said upper surface to said lower surface, the multiplicity of slots comprising four radially extending slots placed approximately ninety degrees apart and extending from the generally circular edge toward the center of the disc but not extending to the central aperture and four generally arcuate extending slots spaced approximately ninety degrees apart and extending from the generally circular edge toward the center of the disc but not extending to the central aperture, the radially extending slots and the arcuate slots respectively positioned so that an arcuate slot is intermediate between two radially extending slots and a radially extending slot is intermediate between two arcuate slots;

c. whereby the multiplicity of radial slots combined with the multiplicity of arcuate slots in the disc provides significantly greater viewing of the work piece during a grinding or polishing operation.

2. The grinding or polishing disc in accordance with claim 1 wherein said disc further comprises:

a. the upper surface having a generally planar portion surrounding the central aperture through which the shaft passes and allows the disc to be coupled thereto for rotation; and b. the upper surface further comprising a tapered portion which extends from the planar portion to the peripheral edge.

3. The grinding or polishing disc in accordance with claim 1 wherein the peripheral edge of the disc has a predetermined axial extent so that there is sufficient structural integrity of the disc at the peripheral edge to withstand the forces involved in the grinding or polishing operation.

4. An improved grinding or polishing disc of the type adapted to have a grinding or polishing material on a lower surface thereof comprising:

a. said grinding or polishing disc having an upper surface, a lower surface, and a center area, a central aperture in the center area extending from the upper surface to the lower surface, the central aperture enabling the disc to be coupled to a rotatable shaft for rotation therewith; and b. said grinding or polishing disc having an upper surface, a generally circular peripheral edge, the lower surface adapted to grind or polish the surface of a work piece, and having walls defining a multiplicity of slots extending through said grinding or polishing disc from said upper surface to said lower surface, the multiplicity of slots comprising at least two spaced apart radially extending slots extending from the generally circular edge toward the center of the disc but not extending to the central aperture and at least two spaced apart generally arcuate extending slots extending from the generally circular edge toward the center of the disc but not extending to the central aperture, the radially extending slots and the arcuate slots respectively positioned so that an arcuate slot is intermediate between two radially extending slots and a radially extending slot is intermediate between two arcuate slots;

c. whereby the multiplicity of radial slots combined with the multiplicity of arcuate slots in the disc provides significantly greater viewing of the work piece during the grinding or polishing operation.

5. The grinding or polishing disc in accordance with claim 4 wherein said disc further comprises:

a. an upper surface having a generally planar portion surrounding the central aperture through which the shaft passes and allows the disc to be coupled thereto for rotation; and b. the upper surface further comprising a tapered portion which extends from the planar portion to the peripheral edge.

6. The grinding or polishing disc in accordance with claim 4 wherein the peripheral edge of the disc has a predetermined axial extent so that there is sufficient structural integrity of the disc at the peripheral edge to withstand the forces involved in the grinding or polishing operation.

7. An improved grinding or polishing disc of the type adapted to have a grinding or polishing material on a lower surface thereof comprising:

a. said grinding or polishing disc having an upper surface, a lower surface, and a center area, a central aperture in the center area extending from the upper surface to the lower surface, the central aperture enabling the disc to be coupled to a rotatable shaft for rotation therewith; and b. said grinding or polishing disc having a generally circular peripheral edge, the lower surface adapted to grind or polish the surface of a work piece, and having walls defining a multiplicity of slots extending through said grinding or polishing disc from said upper surface to said lower surface, the multiplicity of slots comprising at least one radially extending slot extending from the generally circular edge toward the center of the disc but not extending to the central aperture and at least one generally arcuate extending slot extending from the generally circular edge toward the center of the disc but not extending to the central aperture;

c. whereby the multiplicity of slot provides significantly greater viewing of the work piece during a grinding or polishing operation.

8. The grinding or polishing disc in accordance with claim 7 wherein said disc further comprises:

a. the upper surface having a generally planar portion surrounding the central aperture through which the shaft passes and allows the disc to be coupled thereto for rotation; and b. the upper surface further comprising a tapered portion which extends from the planar portion to the peripheral edge.

9. The grinding or polishing disc in accordance with claim 7 wherein the peripheral edge of the disc has a predetermined axial extent so that there is sufficient structural integrity of the disc at the peripheral edge to withstand the forces involved in the grinding or polishing operation.

* * * * *